United States Patent [19]

Chung

[11] Patent Number: 4,864,735

[45] Date of Patent: Sep. 12, 1989

[54] MULTI-PURPOSE PRESENCE GROOMING IMPLEMENT

[76] Inventor: Chang L. Chung, No. 8, Lane 37, Yung Pin Street, Taipei, Taiwan

[21] Appl. No.: 157,236

[22] Filed: Feb. 18, 1988

[51] Int. Cl.[4] ..... F26B 19/00
[52] U.S. Cl. ..... 34/90; 30/45
[58] Field of Search ..... 34/90, 91; 30/45

[56] References Cited

U.S. PATENT DOCUMENTS 3,872,336 3/1975 Lin et al. ..... 34/90 X

*Primary Examiner*—Henry A. Bennet
*Attorney, Agent, or Firm*—Browdy and Neimark

[57] ABSTRACT

This invention discloses a presence grooming implement comprising a hair dryer and an electric razor (or a lint eater), wherein the electric razor (or lint eater) is electrically and mechanically connected to the handle of the hair dryer in a detachable or permanent manner to form a integrated implement which is applicable as a hair dryer, an electric razor and even a lint eater.

9 Claims, 3 Drawing Sheets

MULTI-PURPOSE PRESENCE GROOMING IMPLEMENT

BACKGROUND OF THE INVENTION

This invention relates to a multi-purpose presence grooming implement and, in particular, to a presence grooming implement which is the combination of a hair dryer and an electric razor (or a lint eater) utilizing a common power supply.

It is known that hair dryer, razor and lint eater etc. are all necessary implements for presence grooming work of gentlemen. However, since conventional hair dryer, electric razor and lint eater are all single-purpose implements, several different implements must be used for different presence grooming work, which makes the presence grooming work very inconvenient. In particular, during travelling, the above-described implements necessary for a complete presence grooming job will inevitably occupy considerable space in the trunk and thus greatly reduce available space for other articles. Consequently, the necessity of a more handy, compact multi-purpose presence grooming implement is imminent.

SUMMARY OF THE INVENTION

In view of the afore-mentioned drawbacks suffered by conventional presence grooming implements, the primary object of this invention is to provide a multi-purpose presence grooming implement which possesses both the functions of a hair dryer, and an electric razor (or even a lint eater).

In accordance with a first preferred embodiment of this invention, an eletric razor or a lint eater is electrically and mechanically connected to the handle of a hair dryer in a detachable manner to form an integrated implement applicable both as a hair dryer and an electric razor (or a lint eater).

In accordance with a second embodiment of this invention, an electric razor or a lint eater is electrically and mechanically connected to a portion of a hair dryer opposite to the barrel of the latter in a detachable manner to form an integrated implement applicable both as a hair dryer and an electric razor (or a lint eater ).

BRIEF DESCRIPTION OF THE DRAWINGS

This invention will be more fully understood with reference to the following detailed description and accompanying drawings.

DETAILED DESCRIPTION OF THE EMBODIMENTS

Figure 1:
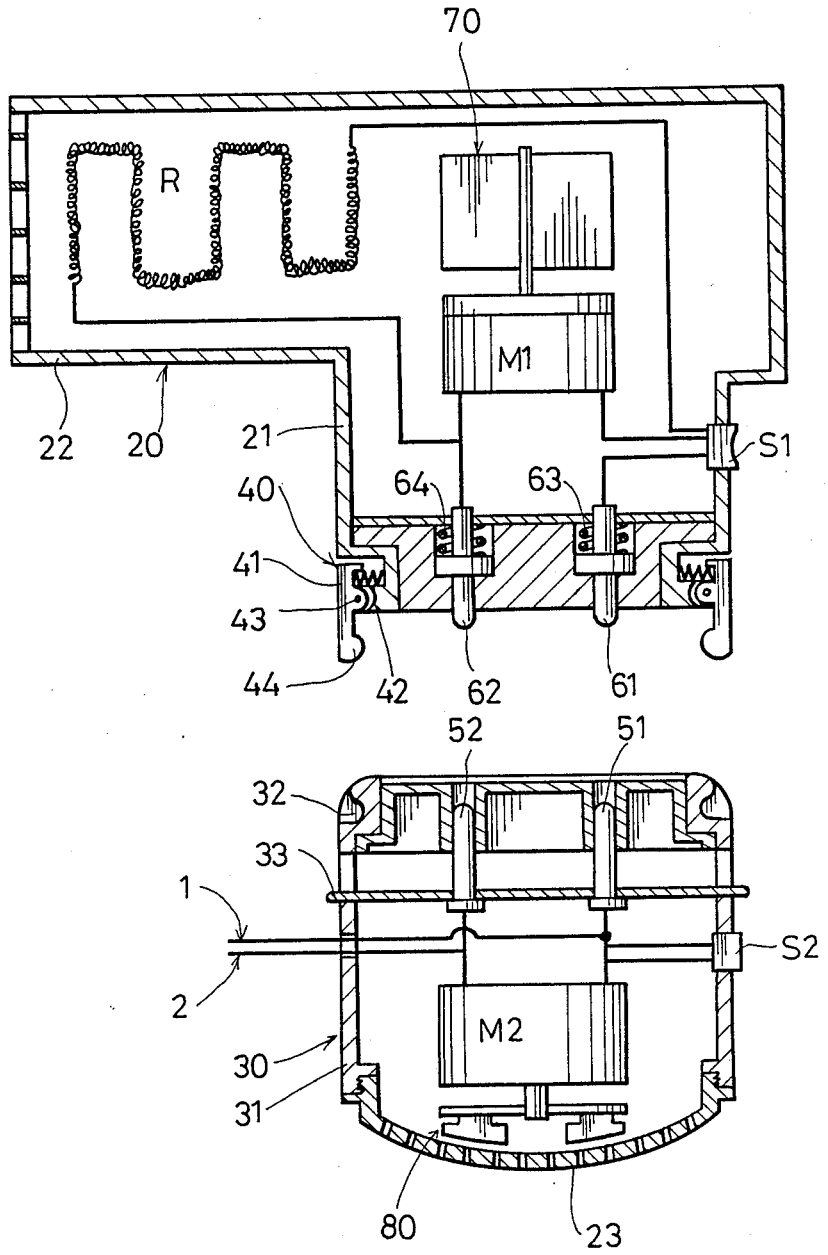
FIG. 1 is a schematic longitudinal sectional view of a presence grooming implement in accordance with the first embodiment of this invention.

The construction of the implement according to the first embodiment of this invention will now be described referring to FIGS. 1 and 2. In this embodiment, the presence grooming implement mainly comprises a hair dryer 20, an electric razor 30 and a fastening mechanism 40 for fastening the hair dryer 20 and the electric razor 30 together. The hair dryer 20 comprises a fan 70, a motor M1 for driving the fan 70, a heater R for generating heat energy, and a three-step switch S1 which can be optionally set at an OFF, COLD WIND or HOT WIND position so as to control the function of the hair dryer 20 by three optional states, namely ( both the fan 70 and the heater R—OFF ), (only the fan 70—ON) and (both the fan 70 and the heater R—ON). Hence, the structure of the hair dryer 20 is substantially the same as a conventional one except that the two power supply wires as commonly used in a conventional hair dryer have been substituted by a first pair of electric conductors 61 and 62. The electric razor 30 comprises a set of cutters 80, a motor M2 for driving the set of cutters 80, and a switch S2 for controlling the rotation of the cutters 80. Consequently, the structure of the electric razor 30 is generally the same as a conventional one except that its power supply wires 1 and 2 diverge before being connected to the switch S2 and the motor M2, respectively, with one branch of each of wires 1 and 2 being, respectively, connected to a second pair of conductors 51 and 52 fixed to a operating plate 33 which is provided within the casing 31 of the razor 30 and partially extends outward of same casing 31. The second pair of conductors 51 and 52 are retracted to the interior of the casing 31 of the razor 30, as shown in FIG. 1. So, when the hair dryer 20 is not in use, they can be pushed out toward the hair dryer 20 through the operation of the operating plate 33, and when the hair dryer 20 is to be used, be contacted with the afore-mentioned first pair of conductors 61 and 62 provided within the hair dryer 20. The second pair of conductors 51 and 52, when being in contact with the first pair of conductors 61 and 62, are prevented from retracting backward by a locking means, which is per se known, unless they are moved back through operation to the operating plate 33. The hair dryer 20 and the electric razor 30 are detachably combined together by a fastening mechanism 40. The fastening mechanism 40 mainly comprises several engaging pawls 41 (only two engaging pawls 41 are shown in FIG. 1), several biasing springs 42 and an engaging groove 32 for being engaged by the engaging pawls 41. As shown in FIG. 1, each engaging pawl 41 is pivotably secured to the lower end of the hair dryer casing 21 at a pivot point 43 and is biased by a biasing spring 42 so as to inwardly force a hook portion 44 formed at the lower end of the engaging pawl 41. The engaging groove 32 is formed in the upper end of the electric razor casing 31. When the hair dryer 20 and the electric razor 30 are to be combined together, they are moved toward each other so as to force the hook portion 44 of each engaging pawl 41 to engage into the engaging groove 32 and remain there under the action of the biasing spring 42. On the contrary, when each engaging pawl 41 is depressed inwardly at the portion above the pivot point 43, the hook portion 44 at the lower end of the engaging pawls 41 will disengage from the engaging groove 32 and thus the electric razor 30 can be easily detached from the hair dryer 20. When the hair dryer 20 and the electric razor 30 are combined together in the manner as described above, the first pair of conductors 61 and 62 within the hair dryer 20 will, respectively, urge against the second pair of conductors 51 and 52 within the electric razor 30 under the action of a pair of springs 63 and 64 and thus power can be supplied to the motor M1 through the wires 1 and 2.

Figure 2:
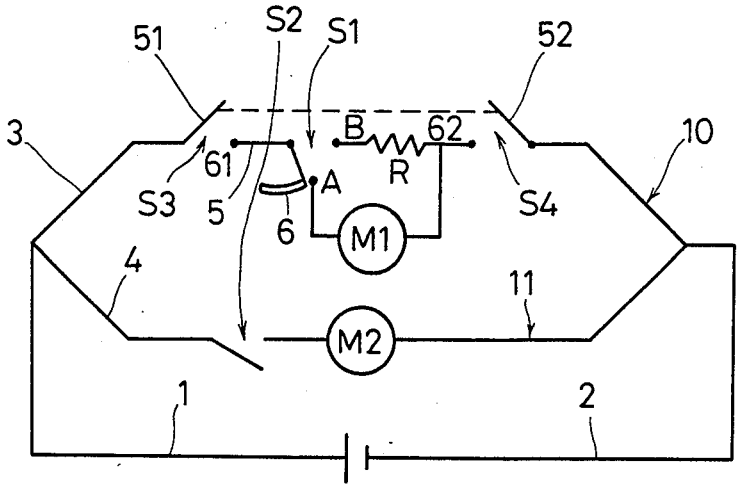
FIG. 2 is an electrical schematic diagram for the implement as shown in FIG. 1.

FIG. 2 is an electric schematic diagram for the implement as shown in FIG. 1. The power wire 1 is diverged into two branch wires 3 and 4 before being connected to the conductor 51. The wire 3 is connected to the conductor 51, while the wire 4 is connected to the motor M2 through the switch S2. The power wire 2 is diverged into two branch wires 10 and 11 before being connected to the conductor 52. The wire 10 is connected to the conductor 52, and the wire 11 to the motor M2. The contact between the conductor 51 and 61 and that between the conductor 52 and 62 occur at the same time due to the fact that both the conductors 51 and 52 are operated by the operating plate 33 in the same manner as described above. Namely, the switches S3 and S4 formed, respectively, by the conductor pairs 51, 61 and 52, 62 are opened or closed at the same time. The connection between the conductors 61 and 62 is as shown in FIG. 2. Namely, the the motor M1 is connected in parallel to the heater R through a three-step switch S1. When the connecting piece 6 in the switch S1 is connected neither to terminal A nor to terminal B, the switch S1 is in a OFF position. When it is connected either to only terminal A or to both terminals A and B, the switch S1 is, respectively, in a COLD WIND or HOT WIND position as described above.

Figure 3:
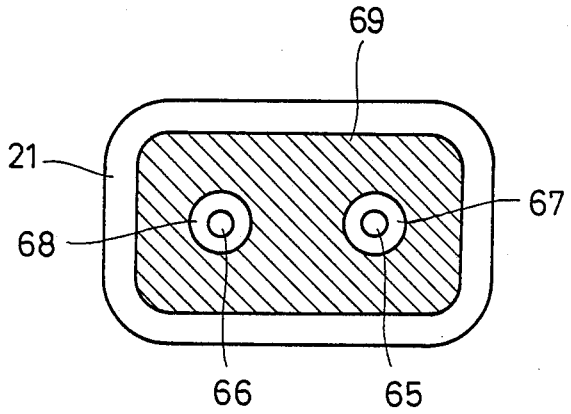
FIG. 3 is a cross-sectional view of another type of fastening mechanism for combining an electric razor to a hair dryer so as to form an integrated implement of this invention.

FIG. 3 shows another alternative fastening mechanism, in cross section, for combining the hair dryer and the electric razor. In this case, two insulators 67 and 68 are, respectively, encompassed around the two conductors 65 and 66 provided within the hair dryer casing 21, and a magnet 69 is filled in the space between the casing 21 and the insulators 67, 68 at the juncture of the hair dryer and the electric razor. Similar structure is provided on the side of the electric razor 30. Thus, the hair dryer 20 and the electric razor 30 can be detachably combined together by means of magnetic force instead of by the engaging mechanism 40 as shown in FIG. 1.

When the implement shown in FIGS. 1 through 3 is to be used as a hair dryer, the operation is exactly the same as a conventional single-purpose hair dryer except that the hair dryer part 20 and the the razor part 30 must be first combined together. On the other hand, when the same implement is to be used as an electric razor, its electric razor part 30 can be directly employed in a separate state (from the hair dryer part 20), or it can also be utilized in a combined (assembled) state with the switch S1 being set to the OFF position.

Figure 4:
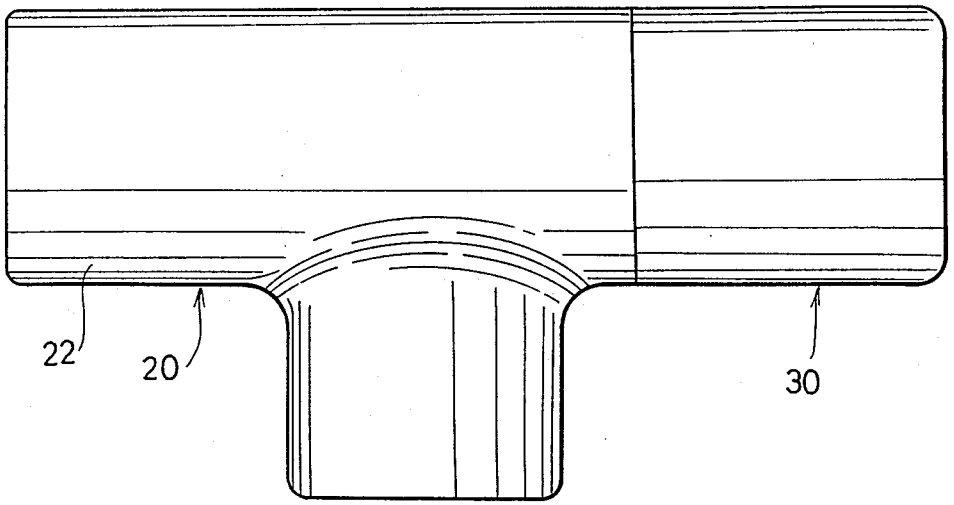
FIG. 4 schematically shows the arrangement of a presence grooming implement in accordance with a second embodiment of this invention.

Although this invention has been described, in the above embodiment, with respect to the case that the electric razor 30 is detachably combined to the handle of the hair dryer 20, the invention is not limited to this combined state. For example, the electric razor part 30 can also be fastened to the opposite side of the barrel 22 of the hair dryer part 20 in a similar manner as shown in FIG. 4. Alternatively, the electric razor part 30 can be permanently combined to the hair dryer handle or to the opposite side of the hair dryer barrel 22. Namely, the hair dryer part 20 and the electrivc razor part 30 may have separate switches S1 and S2, yet have integrally formed common casing. Under this situation, two wires can be used instead of the two pairs of conductors 51, 61 and 52, 62. On the other hand, since the construction of an electric lint eater is substantially the same as that of an electric razor 30 except that the mesh for the perforations of the cover plate 23 (see FIG. 1) in the former case is somewhat larger than the latter case, the replacement of another cover plate suitable for an electric lint eater will enable the implement of this invention to be used also as an electric lint eater.

While this invention has been described in terms of two embodiments, it is to be understood that this invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A presence grooming implement comprising a hair dryer and an electric razor, wherein said hair dryer and said electric razor are provided with separate switches, yet adapted to be connected to a common power supply, said implement further comprising a fastening mechanism for detachably combining said electric razor to said hair dryer, wherein said hair dryer includes a first pair of conductors in the vicinity of the juncture of said hair dryer and said electric razor; wherein said electric razor includes a second pair of conductors, each of which can be operated from the outside of said implement to resiliently contact one of said first pair of conductors; and wherein one pair of said first and second pair of conductors are adapted to be connected to a power supply.

2. A presence grooming implement comprising a hair dryer and an electric razor, wherein said hair dryer and said electric razor are provided with separate switches, yet adapted to be connected to a common power supply, said implement further comprising a fastening mechanism for detachably combining said electric razor to said hair dryer, wherein said fastening mechanism comprises at least one engaging pawl secured to one of said hair dryer and said electric razor, and at least one engaging groove formed in the other of said hair dryer and said electric razor so that said at least one engaging pawl may be engaged into said at least one engaging groove to detachably combine said electric razor and said hair dryer together.

3. A presence grooming implement as described in claim 1, wherein said fastening mechanism comprises at least one engaging pawl secured to one of said hair dryer and said electric razor, and at least one engaging groove formed in the other of said hair dryer and said electric razor so that said at least one engaging pawl may be engaged into said at least one engaging groove to detachably combine said electric razor and said hair dryer together.

4. A presence grooming implement as described in claim 1, wherein said fastening mechanism comprises at least one magnet provided in at least one of said hair dryer and said electric razor in the vicinity of the juncture of said hair dryer and said electric razor so as to combine said hair dryer and said electric razor together.

5. A presence grooming implement as described in claim 1, wherein said hair dryer comprises a handle and said electric razor is combined to said handle.

6. A presence grooming implement as described in claim 2, wherein said hair dryer comprises a handle and said electric razor is combined to said handle.

7. A presence grooming implement as described in claim 3, wherein said hair dryer comprises a handle and said electric razor is combined to said handle.

8. A presence grooming implement comprising a hair dryer and an electric razor, wherein said hair dryer and said electric razor are provided with separate switches, yet adapted to be connected to a common power supply, said implement further comprising a fastening mechanism for detachably combining said electric razor to said hair dryer, wherein said fastening mechanism comprises at least one magnet provided in at least one of said hair dryer and said electric razor in the vicinity of the juncture of said hair dryer and said electric razor so as to combine said hair dryer and said electric razor together, wherein said hair dryer comprises a handle and said electric razor is combined to said handle.

9. A presence grooming implement as described in claim 4, wherein said hair dryer comprises a handle and said electric razor is combined to said handle.

* * * * *